US007052082B1

(12) United States Patent
Thomas

(10) Patent No.: US 7,052,082 B1
(45) Date of Patent: May 30, 2006

(54) PEDICURE BASIN FOR PEDICURE STATION AND SALON CHAIR

(76) Inventor: Richard Thomas, 22228 Calle Royale, Scottsdale, AZ (US) 85022

( * ) Notice: Subject to any disclaimer, the term of this patent is extended or adjusted under 35 U.S.C. 154(b) by 200 days.

(21) Appl. No.: 10/894,695

(22) Filed: Jul. 19, 2004

(51) Int. Cl.

| | |
|---|---|
| ***A47B 83/02*** | (2006.01) |
| ***A47C 7/62*** | (2006.01) |
| ***A47C 7/68*** | (2006.01) |
| ***A47C 7/50*** | (2006.01) |
| ***A47C 16/02*** | (2006.01) |

(52) U.S. Cl. ..... 297/148; 297/174 R; 297/182; 297/217.1; 297/423.1; 297/423.18; 297/423.25; 297/423.38; 297/423.4

(58) Field of Classification Search ..... 297/148, 297/174 R, 182, 217.1, 423.1, 423.18, 423.25, 297/423.38, 423.4

See application file for complete search history.

(56) References Cited

U.S. PATENT DOCUMENTS

| | | | | | |
|---|---|---|---|---|---|
| 606,691 | A * | 7/1898 | Springer | 297/423.38 X |
| 866,072 | A * | 9/1907 | Salomon | 297/423.1 X |
| 1,025,348 | A * | 5/1912 | Webster | 297/217.1 |
| 1,236,517 | A * | 8/1917 | Wemple et al. | 297/423.38 X |
| 1,301,248 | A * | 4/1919 | Fuller | 297/217.1 |
| 1,596,287 | A * | 8/1926 | Mieczkowski | 297/423.1 X |
| 1,652,065 | A * | 12/1927 | Tascarella | 297/423.38 X |
| 1,887,323 | A * | 11/1932 | Perron | 297/423.38 X |
| 1,964,216 | A * | 6/1934 | Sargent | 297/423.38 |
| 2,083,053 | A * | 6/1937 | Collins | 297/423.38 X |
| 2,177,174 | A * | 10/1939 | Eccles | 297/423.4 X |
| 2,519,771 | A * | 8/1950 | Lacore | 297/423.38 X |
| 2,919,748 | A * | 1/1960 | Alden, Sr. | 297/174 R X |
| 3,085,842 | A * | 4/1963 | Johnson | 312/209 |
| 3,173,729 | A * | 3/1965 | Luke | 312/209 |
| 3,635,522 | A * | 1/1972 | Kerwit | 297/153 |
| 3,656,809 | A * | 4/1972 | Ronning | 297/423.1 X |
| 3,788,695 | A * | 1/1974 | Salem | 297/6 |
| 4,944,556 | A * | 7/1990 | Griesbaum et al. | 297/423.38 |
| 5,378,044 | A * | 1/1995 | Rhodes | 297/423.25 |
| 5,489,140 | A * | 2/1996 | Van Horn-Plato | 297/182 X |
| 5,966,750 | A * | 10/1999 | Polanco | 297/DIG. 4 X |
| 6,832,688 | B1 * | 12/2004 | Rivera et al. | 312/209 X |
| 6,840,583 | B1 * | 1/2005 | Turner et al. | 297/423.4 X |
| 6,842,919 | B1 * | 1/2005 | Wilson et al. | 297/180.15 X |
| 2004/0070237 | A1 * | 4/2004 | Wilson et al. | 297/180.15 |

OTHER PUBLICATIONS

Page 23 of a salon furnishings catalog published by Universal Companies, Inc. of Abingdon, Virginia more than one year before the above-identified patent application was filed.

* cited by examiner

*Primary Examiner*—Rodney B. White
(74) *Attorney, Agent, or Firm*—Cahill von Hellens & Glazer, P.L.C.

(57) ABSTRACT

A salon chair includes a pedicure basin positioned between the foot of the chair and a front step opposite the foot of the chair. The pedicure basin includes a bottom floor, a perforated stepping surface above the bottom floor of the basin, and a nozzle assembly disposed between the bottom floor and the stepping surface for agitating water in the pedicure basin. Pressurized air is directed out of the nozzle assembly to induce a whirlpool action in the water held by the basin. The stepping surface may remain in the pedicure basin for days at a time, but may be removed when desired for cleaning purposes. The front step includes a cut-out, or groove, allowing allows a technician's chair to pull up closer to a person seated in the salon chair.

19 Claims, 6 Drawing Sheets

PEDICURE BASIN FOR PEDICURE STATION AND SALON CHAIR

FIELD OF THE INVENTION

The present invention relates generally to salon chairs used for services such as pedicures, manicures, facials and other related services, and more specifically to such a chair having an improved pedicure basin.

DESCRIPTION OF THE RELATED ART

Chairs used in professional beauty salons have become particularly versatile, allowing a customer to receive a facial, manicure, and pedicure while sitting at a single work station. Such salon chairs may include a removable work tray installed after a client sits in the salon chair for resting the client's hand on such work tray to facilitate a manicure. Such salon chairs may also include a pedicure basin at the foot of the chair to facilitate pedicure services. The pedicure basin typically includes a faucet for adding water to the basin, a drain for draining water from the basin, and may further include water pressure jets for inducing a Jacuzzi-type whirlpool action to massage and clean the client's feet.

In the case of known salon chairs of the type wherein the pedicure basin is secured to the foot of the salon chair, the client must typically step into the pedicure basin en route to sitting in the chair. Such pedicure basins, however, are usually not designed to bear all of the weight of a person, and clients who step into such basins often damage the pressurized spray nozzles provided at the bottom of such pedicure basins to provide the aforementioned whirlpool action. Additionally, such spray nozzles provide a bumpy, irregular surface which is awkward to step upon.

The present applicant initially attempted to solve such problem by providing a plexiglass platform equipped with short legs for insertion into the pedicure basin in order to bear the weight of the person getting into or out of the chair. The plexiglass platform covered the floor of the pedicure basin and protected the spray nozzles from damage when a client was getting into or out of the chair. However, the plexiglass platform had to be removed from the pedicure basin by the service technician each time the client sat in the chair, and had to be re-inserted into the pedicure basin each time the client desired to leave the chair. Otherwise, the plexiglass platform would interfere with the whirlpool action of the pressurized water nozzles and prevent the pressurized jets of water from reaching the client's feet. While such platform protected the floor of the pedicure basin from damage, the necessity to constantly insert and remove the plexiglass platform posed its own disadvantages for the service technician.

Accordingly, it is an object of the present invention to provide a salon chair having a pedicure basin which includes the feature of massaging the client's feet without risk of damage to the whirlpool action inducing nozzles provided proximate the floor of the basin. Another object of the present invention is to provide such a salon chair which provides a safe, sturdy and comfortable surface for a client to step upon when getting into and out of the salon chair.

Yet another object of the present invention to provide such a salon chair which does not require a service technician to insert into and/or remove from the pedicure basin any protective platforms each time the client proceeds to enter or exit the salon chair.

Still another object of the present invention to provide such a salon chair having a front step to assist a user in stepping into and out of the pedicure basin.

A further object of the present invention is to provide such a salon chair wherein such front step does not impede access to the client by a service technician sitting in a technician's chair.

These and other objects of the present invention will become more apparent to those skilled in the art as the description of the present invention proceeds.

SUMMARY OF THE INVENTION

Briefly described, and in accordance with a preferred embodiment thereof, the present invention relates to a salon chair having a seat, a foot portion located below and forward of the seat, and a pedicure basin disposed at the foot of the salon chair. If desired, such salon chair may also include a manicure tabletop removably secured at an arm-level position of the chair, and upon which a salon patron seated in the salon chair can place the patron's hands for a manicure or the like.

The pedicure basin includes a bottom floor extending upwardly along side walls. A platform having a perforated stepping surface is inserted within the pedicure basin, and the stepping surface extends above the bottom floor. A nozzle assembly is located between the bottom floor and the stepping surface for agitating water contained by the pedicure basin, whereby the perforations in the stepping surface allow the agitated water to flow through the stepping surface. The stepping surface is preferably essentially flat, and the perforations formed in the stepping surface may be arranged as an array of spaced holes. The platform preferably includes vertical side walls or similar support elements for supporting the stepping surface above the bottom floor and spaced apart therefrom.

The aforementioned platform is removable from said pedicure basin when desired for purposes of maintenance and cleaning, but need not be removed each time that a pedicure is to be performed. The perforated stepping surface may include a drain access opening for accessing the drain plug in the floor of the pedicure basin, if desired.

The nozzle assembly may communicate with a side-wall of the pedicure basin, as by being removably attached thereto, for receiving a pressurized fluid. The nozzle assembly may consist of a hollow, perforated rod for distributing the pressurized fluid through such perforations. In the preferred embodiment, such nozzle assembly communicates with a source of pressurized air to agitate the water contained by the pedicure basin. Apart from the nozzle assembly, the pedicure basin also preferably includes a water inlet source for filling the pedicure basin with water.

The salon chair of the present invention also preferably includes a front step disposed opposite the foot portion of the salon chair on the opposite side of the pedicure basin; this front step assists a user in stepping into and out of the pedicure basin as the user enters, and later exits, the salon chair. This forwardmost portion of the front step, i.e., the side extending away from the salon chair, preferably includes a groove projecting toward the pedicure basin. This groove in the front step is adapted to receive a leg of a salon technician's chair for allowing the salon technician to advance the technician's chair closer to the salon patron.

While the pedicure basin is preferably attached to the foot of the salon chair, the improved pedicure basin structure described above may also be incorporated within a pedicure basin that is detachable from the foot of the salon chair.

DETAILED DESCRIPTION OF THE PREFERRED EMBODIMENTS

Figure 1:
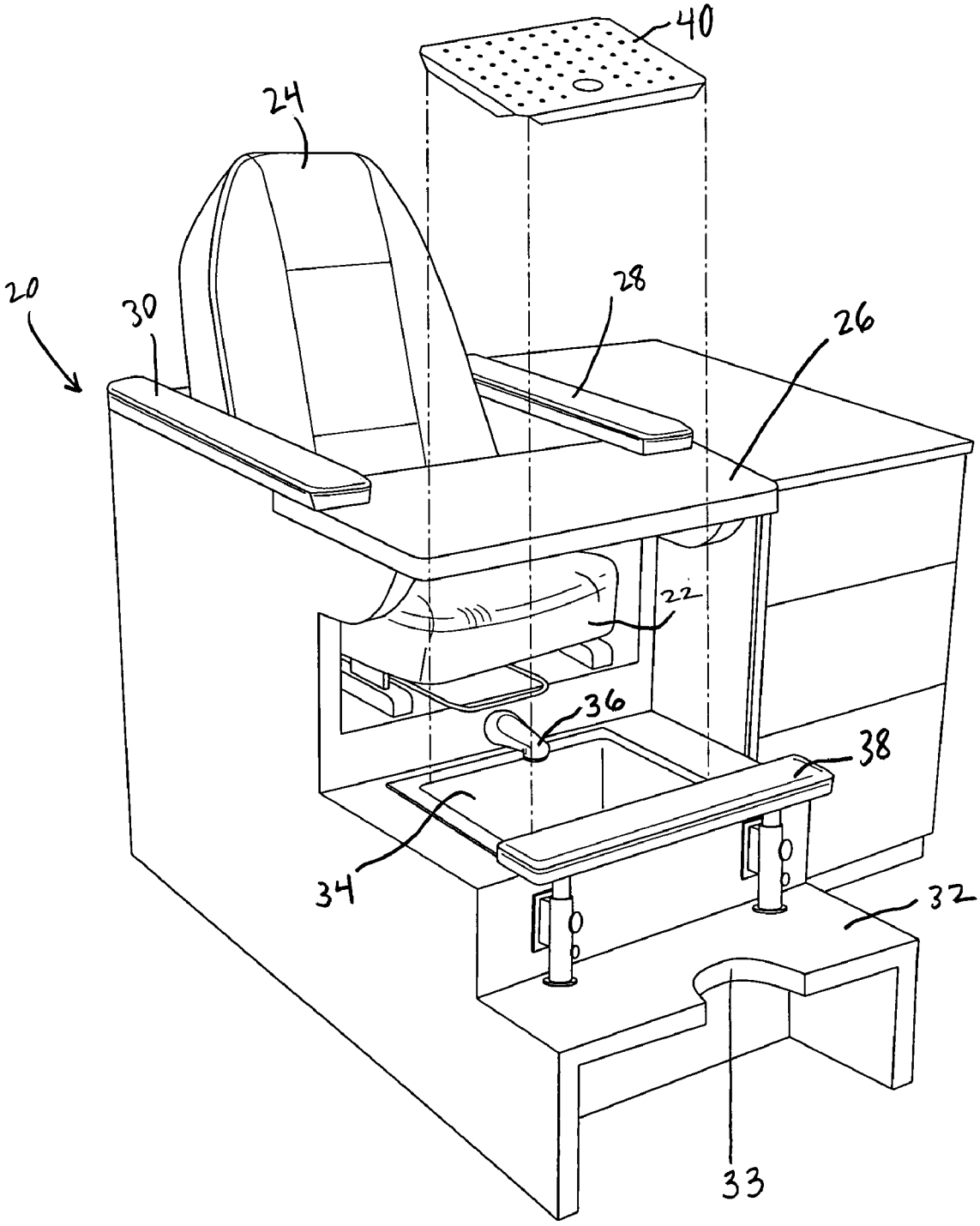
FIG. 1 is a perspective view of a salon chair station including a pedicure basin and front step incorporating the present invention.

FIG. 1 illustrates a salon chair 20 constructed in accordance with a preferred embodiment of the present invention. Salon chair 20 includes a seat 22, a backrest 24, and a pair of armrests 28 and 30. A manicure tabletop 26 is positioned at arm level and may be removably coupled to salon chair 20, as by sliding into retaining slots formed below armrests 28 and 30. Manicure tabletop 26 provides a resting surface for the hands of a patron seated in salon chair 20 for receiving a manicure. Tabletop 26 may be removed when the patron enters or exits salon chair 20.

Also shown in FIG. 1 is a pedicure basin 34 located at the foot of salon chair 20 below and forward of seat 22. Pedicure basin 34 includes a water inlet source, in the form of faucet 36, for adding water to pedicure basin 34. A padded footrest 38, adjustable in height, may also be provided to support the patron's feet during certain pedicure operations.

A front step 32 is provided in front of pedicure basin 34 opposite the foot of salon chair 20. A patron entering salon chair 20 first steps onto front step 33, then steps into basin 34, and from there rotates the patron's body into alignment with seat 22. Front step 32 includes a groove, or cut-out 33, the function of which is described in greater detail below.

Still referring to FIG. 1, a platform 40 is shown in a raised position removed from pedicure basin 34. As explained below, platform 40 serves to bear the weight of the patron, as the patron steps into and/or out of pedicure basin 34, as the patrons enters or exits salon chair 20.

Figure 2:
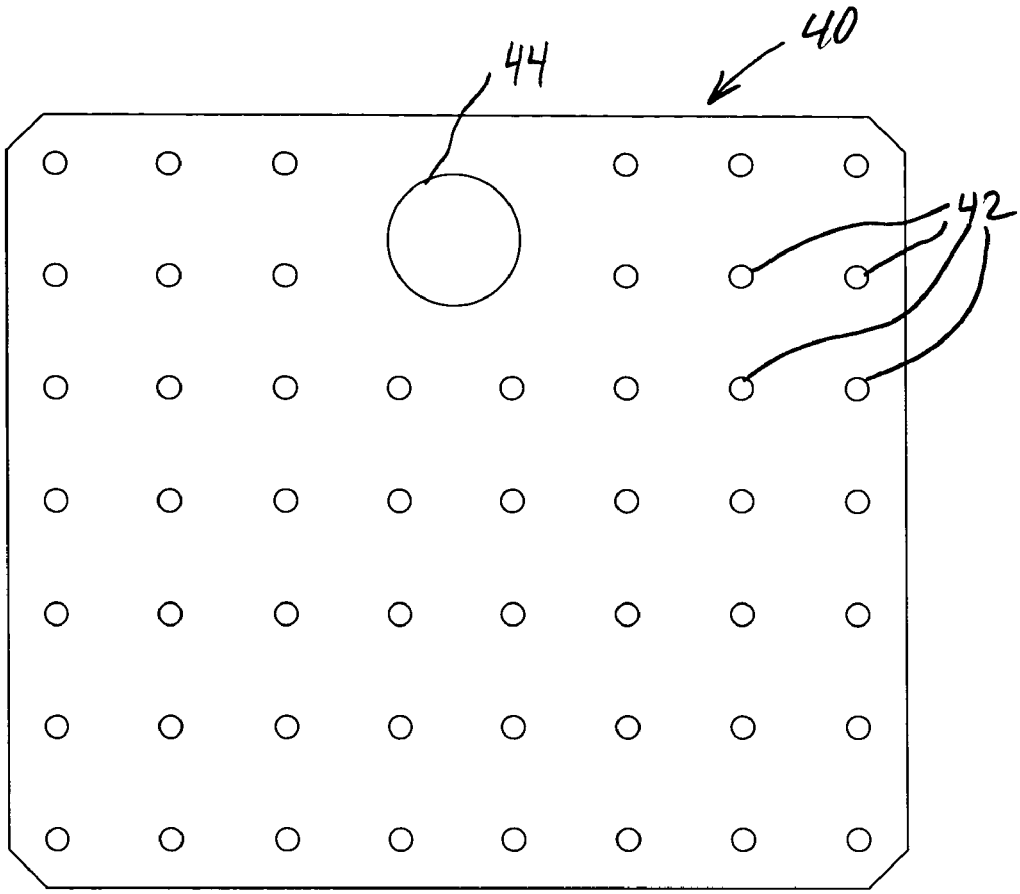
FIG. 2 is a top view of a platform including a raised, perforated stepping surface.
Figure 3:
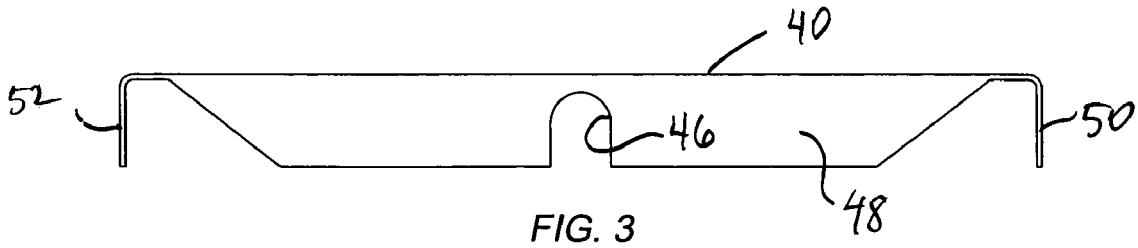
FIG. 3 is side-view of the platform shown in FIG. 2.
Figure 4:
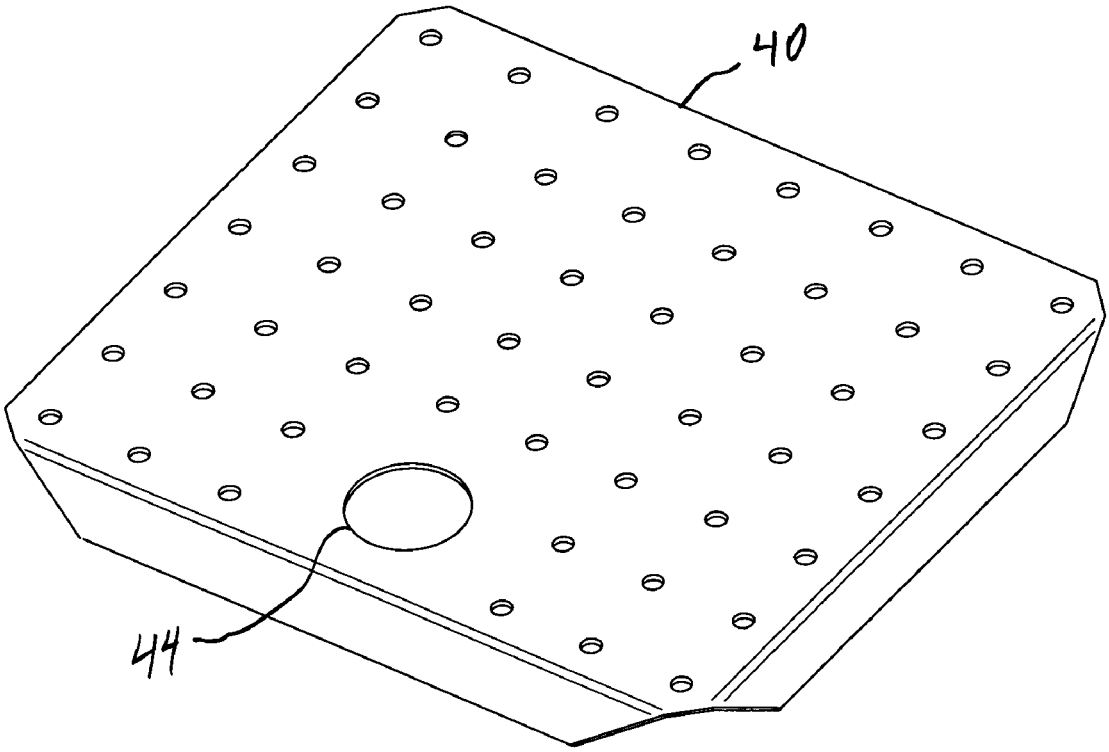
FIG. 4 is a perspective view of the platform shown in FIG. 2.
Figure 5:
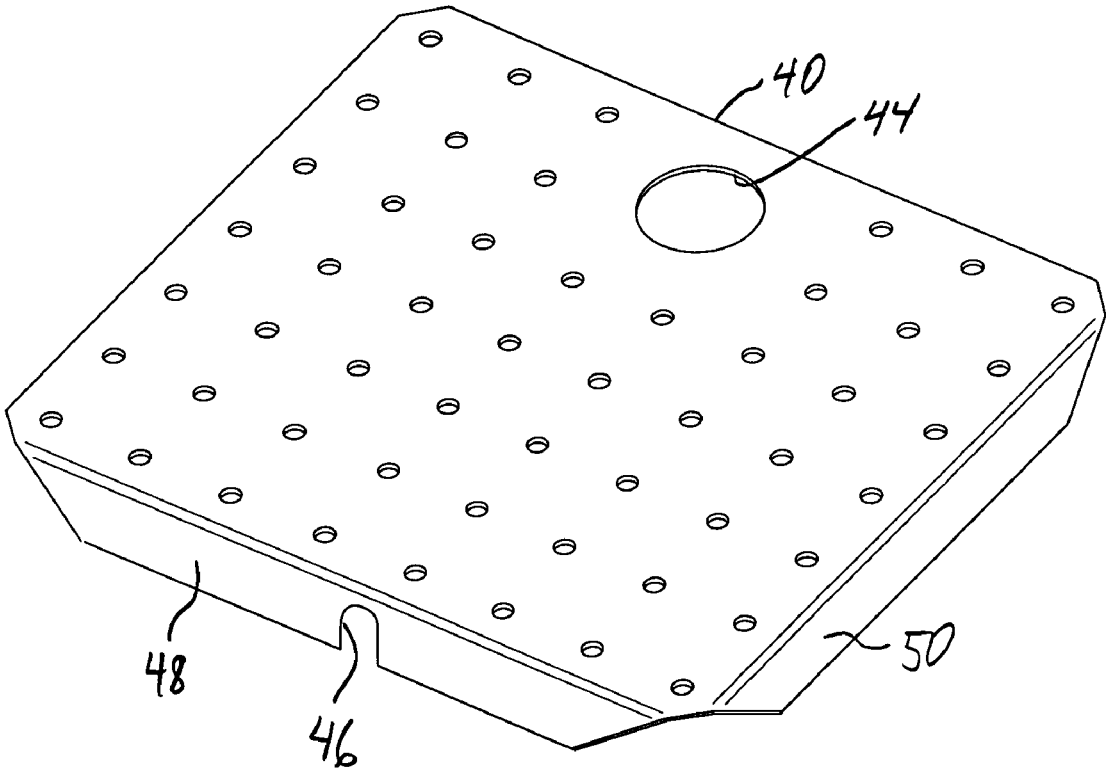
FIG. 5 is a perspective view of the platform showing a groove for passive of a hollow rod.
Figure 6:
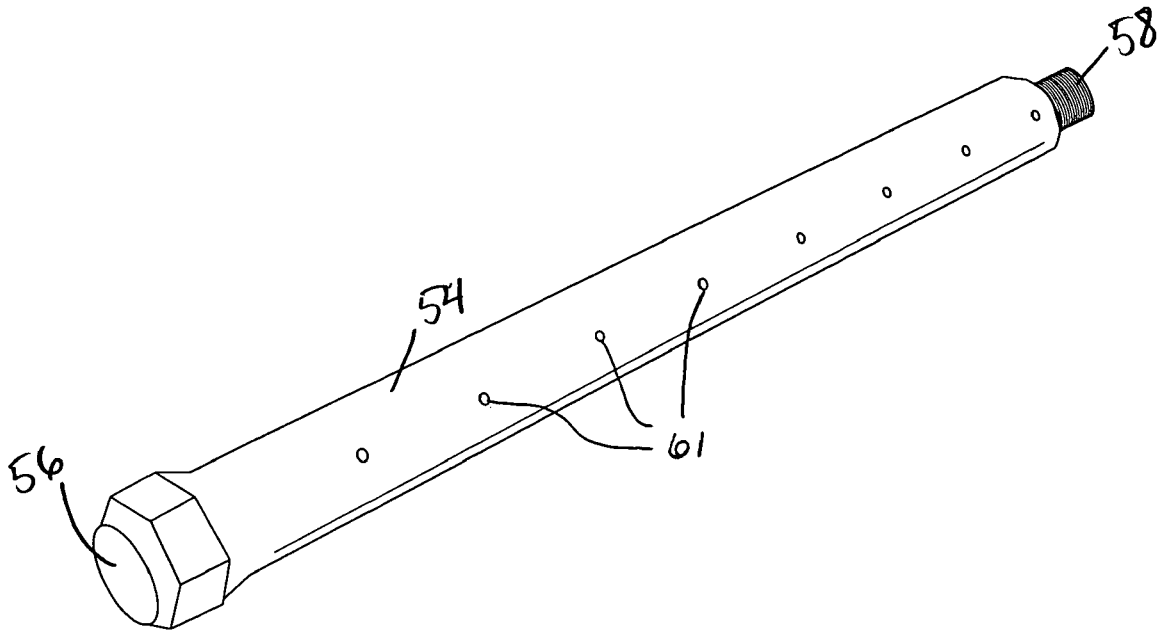
FIG. 6 is a perspective view of a hollow rod forming a nozzle assembly.
Figure 7:
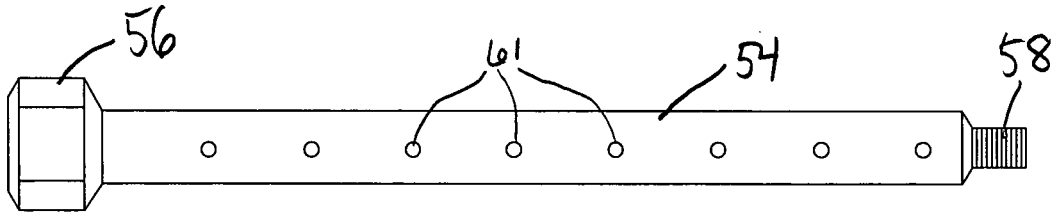
FIG. 7 is a side-view of the nozzle assembly shown in FIG. 6.
Figure 8:
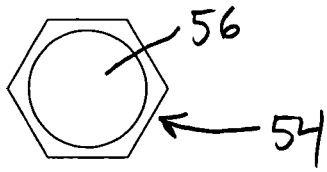
FIG. 8. is an end-view of the nozzle assembly viewed from the closed end thereof.

Referring now to FIGS. 2–5, platform 40 includes an essentially flat, horizontal stepping surface including perforations formed therein; while described as being essentially flat, such stepping surface may be contoured to avoid slippage, without presenting an uncomfortable surface to the user. As shown in FIGS. 2, 4 and 5, such perforations may include an array of spaced holes like those designated by reference numeral 42 in FIG. 2. Platform 40 includes four vertical side walls, like those designated 48, 50 and 52 in FIG. 3, which serve as legs, or support elements, for supporting the horizontal stepping surface of platform 40 above the bottom floor (see FIG. 9) of the pedicure basin 34, spaced apart therefrom for reasons to be explained below.

Figure 9:
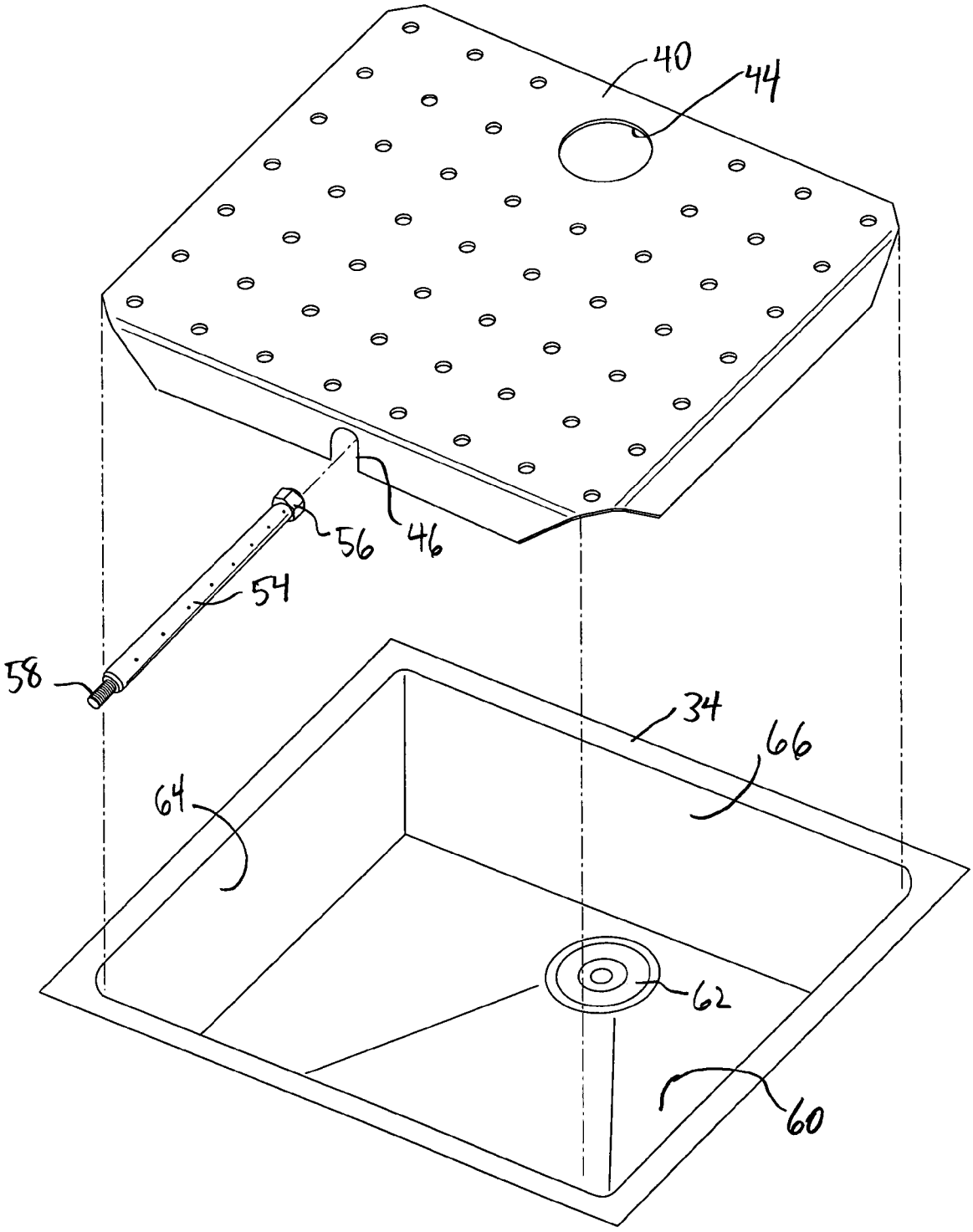
FIG. 9 is an exploded perspective view of the pedicure basin, related stepping surface and nozzle assembly.

As indicated in FIG. 1, platform 40 can be removed, when desired, by simply raising platform 40 out of pedicure basin 34. Removal of platform 40 can be advantageous when performing cleaning or maintenance operations on pedicure basin 34. Referring briefly to FIG. 9, bottom floor 60 of pedicure basin 34 includes a drain hole 62 and associated drain plug. Platform 40 preferably includes a drain access opening 44 formed in the stepping surface thereof for allowing a service technician access to drain 62 on basin floor 60.

Figure 10:
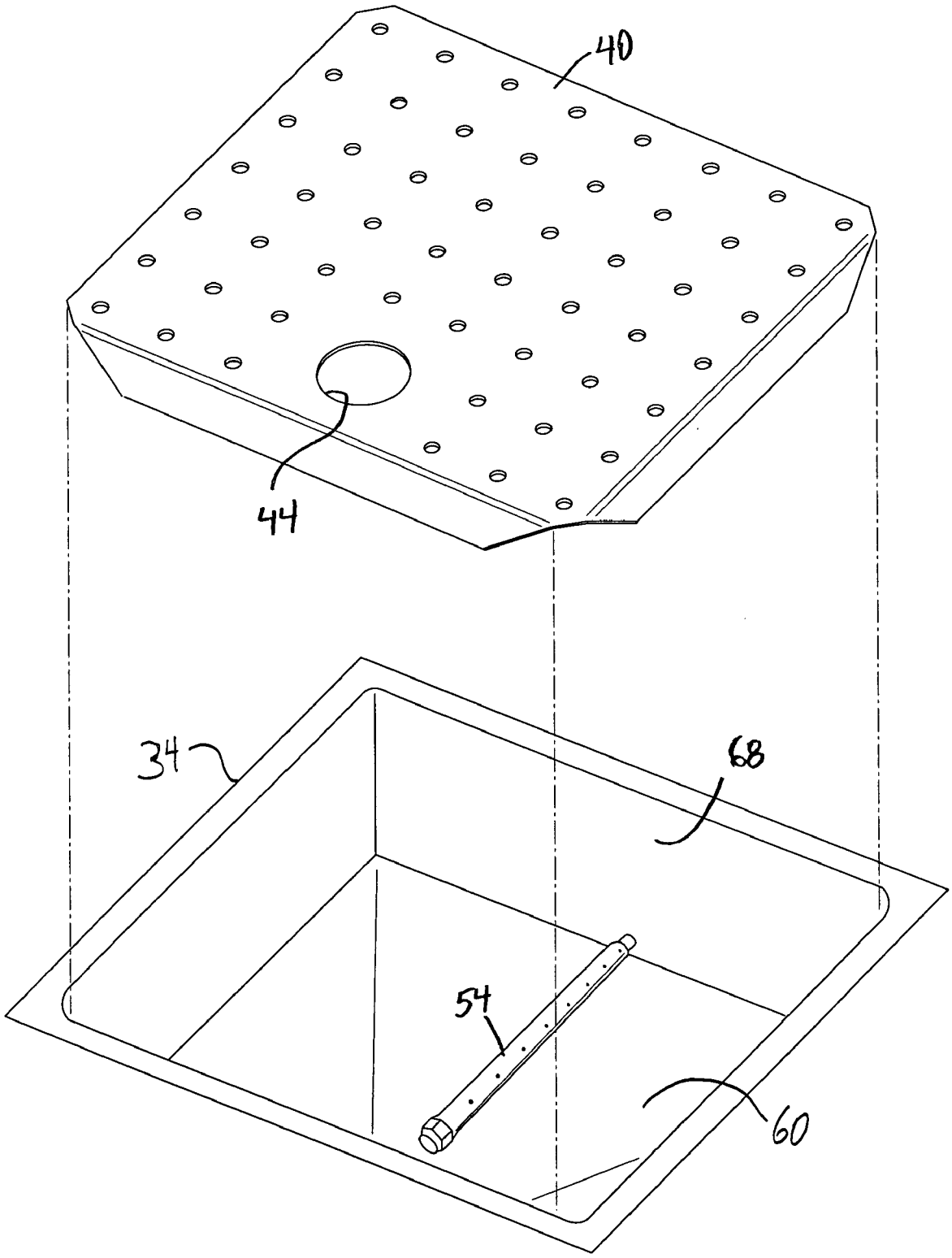
FIG. 10 is a perspective view of the pedicure basin with the platform removed to illustrate the assembled position of the nozzle assembly.

As mentioned above, pedicure basin 34 preferably includes a nozzle assembly 54 shown in FIGS. 6–10 for agitating water contained by pedicure basin 34. Nozzle assembly 54 preferably takes the form of a hollow perforated rod having first and second opposing ends 56 and 58. As indicated by FIGS. 9 and 10, nozzle rod 54 extends just above basin floor 60 and just below the horizontal stepping surface of platform 40. End 56 is closed, while opposing end 58 is preferably threaded. Pressurized fluid (air or water) is forced into threaded end 58 for distribution into pedicure basin 34 through a series of perforations 61 formed in nozzle rod 54; preferably, such perforation extend along opposing sides of nozzle rod 54, i.e., at 180 degree intervals around the diameter of nozzle rod 54. Such pressurized fluid agitates the water in pedicure basin 34. Moreover, the perforations 42 in the horizontal stepping surface of platform 40 allow the agitated water to flow therethrough for massaging the patron's feet. Accordingly, it is not necessary to remove platform 40 when massaging the patron's feet within pedicure basin 34.

As shown in FIGS. 9 and 10, pedicure basin 34 includes four side walls including those designated 64, 66 and 68. The threaded end 58 of nozzle rod 54 is adapted to threadedly engage a fluid communication port formed in side wall 68, thereby securing nozzle rod 54 in proper position within pedicure basin 34, and also sourcing pressurized air, water, or other fluid thereto. When desired, nozzle rod 54 may be unthreaded from side wall 68 to perform maintenance or to provide unrestricted access to basin floor 60. Referring to FIGS. 3 and 5, side wall 48 of platform 40 has a groove 46 formed therein for allowing nozzle rod 54 to pass therethrough when platform 40 rests upon basin floor 60.

Returning to FIG. 1 of the drawings, it was noted earlier that salon chair 20 includes a front step 32 disposed opposite the foot of salon chair 20, on an opposing side of pedicure basin 34, to assist a user in stepping into and out of pedicure basin 34 when entering and exiting salon chair 20; it was further noted above that front step 32 has a cutout 33 formed therein and projecting toward pedicure basin 34. Cutout 33 is adapted to permit the leg of a salon technician's chair to move into such cutout for allowing the technician's chair to be advanced closer toward the patron than would otherwise be possible; this is especially helpful when providing a manicure service.

Those skilled in the art will appreciate that the stepping surface of platform 40 may be made of stainless steel or other strong materials for reliably supporting the weight of patrons stepping into and out of pedicure basin 34 without damage to nozzle rod 54. At the same time, it will be appreciated that platform need not be removed from pedicure basin after a customer steps in for a pedicure service, as the perforated stepping surface permits the agitated water to flow therethrough in order to massage the patron's feet. Nonetheless, platform 40 can be removed when desired, making pedicure basin 34 and its components easy to clean and maintain. As noted above, pedicure basin 34 may be provided manufactured separate from salon chair 20 if desired, and subsequently joined to the foot of the salon chair. Various other modifications and changes may be made to the described embodiment by those skilled in the art without departing from the true spirit and scope of the invention as defined by the appended claims.

I claim:

1. A salon chair comprising:

a) a seat;

b) a foot portion of the salon chair located below and forward of the seat;

c) a pedicure basin disposed at the foot of the salon chair, said pedicure basin including:

i) a bottom floor;

ii) a platform having a stepping surface inserted within said pedicure basin, said stepping surface extending above said bottom floor, and having perforations formed therein; and iii) a nozzle assembly disposed between said bottom floor and said stepping surface for agitating water contained by said pedicure basin, the perforations in said stepping surface allowing the agitated water to flow through the stepping surface.

2. The salon chair recited by claim 1 wherein said platform is removable from said pedicure basin for purposes of maintenance and cleaning.

3. The salon chair recited by claim 1 wherein said bottom floor includes a drain plug, and wherein said stepping surface includes a drain access opening for accessing the drain plug.

4. The salon chair recited by claim 1 wherein the perforations in said stepping surface include an array of spaced holes.

5. The salon chair recited by claim 1 wherein said stepping surface has a substantially flat top face.

6. The salon chair recited by claim 1 wherein said platform includes support elements for supporting said stepping surface above said bottom floor and spaced apart therefrom.

7. The salon chair recited by claim 1 wherein said pedicure basin includes at least one side wall, and wherein said nozzle assembly communicates with a side-wall of said pedicure basin.

8. The salon chair recited by claim 1 wherein said nozzle assembly is a hollow rod for passing fluid therethrough.

9. The salon chair recited by claim 8 wherein said pedicure basin includes at least one side wall, and wherein said hollow rod has a first end attached to a side wall of said pedicure basin.

10. The salon chair recited by claim 8 wherein said hollow rod has perforations formed therein for distributing fluid through said perforations.

11. The salon chair recited by claim 1 wherein said nozzle assembly communicates with a source of pressurized air to agitate water contained by said pedicure basin.

12. The salon chair recited by claim 1 wherein said nozzle assembly is attachable to, and detachable from, said pedicure basin.

13. The salon chair recited by claim 1 further comprising a water inlet source for adding water to said pedicure basin.

14. The salon chair recited by claim 1 further comprising a front step disposed opposite the foot portion of said salon chair, on an opposing side of said pedicure basin, to assist a user in stepping into and out of said pedicure basin when entering and exiting said salon chair.

15. The salon chair recited by claim 14 wherein said front step includes a stepping surface has a back side adjacent to said pedicure basin and an opposing front side extending away from said salon chair, the front side having a groove formed therein and projecting toward said pedicure basin, said groove being adapted to receive a leg of a salon technician's chair.

16. A salon chair having a seat and a foot portion, comprising:

a pedicure basin located at the foot portion of said salon chair for receiving the feet of a person seated in said salon chair; and a front step disposed opposite the foot portion of said salon chair, on an opposing side of said pedicure basin from the foot portion of said salon chair, to assist a user in stepping into and out of said pedicure basin when entering and exiting said salon chair, said front step including a back side adjacent to said pedicure basin and an opposing front side extending away from said salon chair, the front side having a groove formed therein and projecting toward said pedicure basin, said groove being adapted to receive a leg of a salon technician's chair.

17. The salon chair recited by claim 16 further comprising a manicure tabletop at an arm-level position of the chair, on which a user seated in said salon chair can place the user's hands.

18. A pedicure basin comprising:

a bottom floor;

a stepping surface above said bottom floor, said stepping surface including holes; and a nozzle assembly disposed between said bottom floor and said stepping surface for agitating water contained by said pedicure basin.

19. The pedicure basin recited by claim 18 wherein said pedicure basin is disposed proximate a foot portion of a salon chair for a pedicure station.

* * * * *